United States Patent [19]

Crosby

[11] 4,270,683

[45] Jun. 2, 1981

[54] PORTABLE PAPER ROLL BREAKING MACHINE

[76] Inventor: David Crosby, P.O. Box 427, International Falls, Minn. 56649

[21] Appl. No.: 80,511

[22] Filed: Oct. 1, 1979

[51] Int. Cl.[3] ..... B26F 3/00

[52] U.S. Cl. ..... 225/103; 225/93; 254/129

[58] Field of Search ..... 225/103, 93; 83/605-608; 74/96, 97, 104, 102, 103, 519, 522, 522.5, 532; 254/120, 123, 124, 129, 131

[56] References Cited

U.S. PATENT DOCUMENTS

| | | | |
|---|---|---|---|
| 1,341,277 | 5/1920 | Monkhorst | 366/114 |
| 1,844,809 | 2/1932 | Spaugh | 254/129 |
| 2,537,464 | 1/1951 | Holmberg | 225/103 X |
| 2,742,965 | 4/1956 | Drummond, Jr. | 225/103 |
| 2,748,607 | 6/1956 | Karlstrom | 74/61 |
| 3,205,747 | 9/1965 | Guth | 83/605 |
| 3,331,586 | 7/1967 | Primoff | 254/123 |
| 3,498,384 | 3/1970 | Ogura | 172/40 |
| 3,592,370 | 7/1971 | Boardman | 225/103 X |
| 4,176,774 | 12/1979 | Rogers | 225/103 |

*Primary Examiner*—Frank T. Yost

*Attorney, Agent, or Firm*—Merchant, Gould, Smith, Edell, Welter & Schmidt

[57] ABSTRACT

A roll breaker (20) in the form of a lever (130) of the first class with a fulcrum (54) adjustable in height. A striker assembly 70 is positioned near one end (136) of the lever, and the other end (131) is inserted in the roll to be broken. When the striker is wound and triggered, by a motor (112), it impacts downward on the lever end 136. A bumper (30) is provided to determine the depth of insertion of the lever end (131) into the roll, and an arrangement (137, 140) is also provided to prevent the second end of the lever from rising above a predetermined level.

7 Claims, 4 Drawing Figures

PORTABLE PAPER ROLL BREAKING MACHINE

TECHNICAL FIELD

This invention relates to the field of paper making, and particularly to means for facilitating the separation or breaking apart of axially abutting rolls of finished paper wound about a common axis.

BACKGROUND OF THE PRIOR ART

Paper is frequently supplied from paper mills in the form of rolls, of length and width required by the purchaser. In the final stage of manufacture a band of paper, from a reel which may be thirteen or fourteen feet wide, is passed through apparatus which cuts the band into a number of longitudinal strips, of selected widths, and rewinds them all simultaneously about a common axis, to give a set of rolls which abut end to end, each roll being between six and a half inches and thirty-six inches in width, and the rolls having a common diameter of thirty inches to fifty inches, for example.

In theory these rolls are entirely separate after rewinding, but in practice little overlaps occur during the rewinding process, due to uneven moisture in the set, or to vibration in the rewinding machinery caused by excess bearing clearance in the machine, or development of out-of-round in the rolls being rewound. Paper movement is at the rate of 5000 to 7000 feet per minute, so it is extremely difficult to avoid vibrations.

After a roll of the desired diameter is rewound, it is removed from the machine and the shaft on which the paper was rewound is pulled out of the roll axially. Normally about half of the rolls break apart axially fairly easily; others may be separated by manually inserting one end of a pipe axially into the end of the roll, and lifting up on the other end of the pipe with a snapping or dropping action. This is obviously a procedure calling not only for skill but for physical strength, and back injuries to paper makers performing this function are not uncommon.

It also frequently happens that two or more rolls are so bound together by overlaps that they cannot be separated as above, and it becomes necessary to drive wooden wedges between the rolls to separate them. This is injurious to the paper, and purchasers sometimes refuse to accept paper bearing wedge marks.

It is thus desirable to develop apparatus for separating or "breaking" the rolls from a rewinding machine easily, efficiently, safely, and without damage to the paper.

SUMMARY OF THE INVENTION

A roll breaker according to the invention includes a wheeled platform for portability. Near one end of the platform is mounted a vertically adjustable fulcrum member, and near the other end is mounted a striking mechanism. A main bar rests on the fulcrum member as a lever of the first class, the first end thereof, that remote from the striking mechanism, being inserted into one of the rolls to be separated. A striker is wound and released by a reversible winch to impact the second end of the main bar transversely, the resulting shock being effective, with repetition if necessary, to break the roll on the main bar from the adjacent roll. In stubborn cases, the roll to be separated may be lifted off the floor before impacting is triggered.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DETAILED DESCRIPTION OF THE INVENTION

Figures 1, 4:
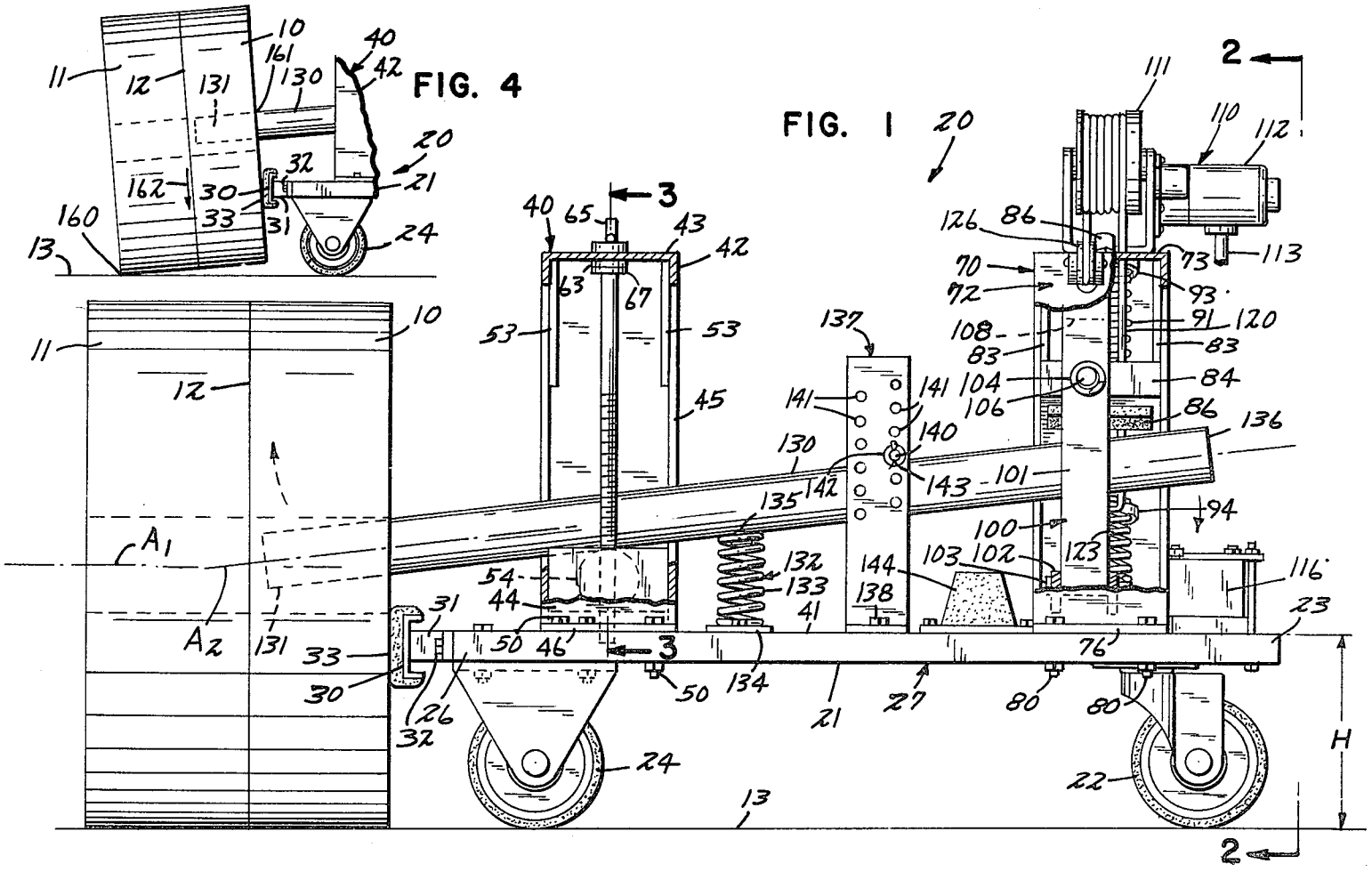
FIG. 1 is a side view of my apparatus, parts being broken away and shown in section for clarity of illustration.
FIG. 4 is a fragmentary view generally like FIG. 1, showing a different operation.

In the drawing, a pair of paper rolls 10 and 11 are to be broken apart along a cut line 12. They are shown as lying on a level surface or floor 13, to which their common axis $A_1$ is parallel. My breaking apparatus 20 includes a platform 21 mounted on wheels including a castored wheel 22 beneath the center of platform 21 near a first end 23 thereof, and a pair of fixed wheels 24, 25 beneath the platform near the corners of the second end 26 thereof, to form a cart 27. If desired means may be incorporated into cart 27 for varying the height H of the platform from the floor.

A bumper 30 is mounted at the end 26 of cart 27, by means such as a bracket 31 and fasteners 32, for axially engaging the end of a roll 10, and includes a pad 33 of carpeting material to protect the rolls.

Figure 3:
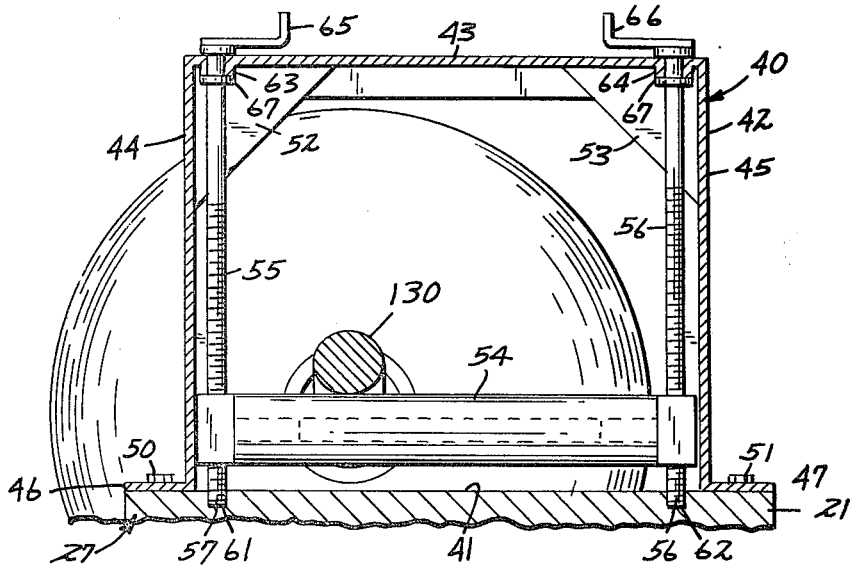
FIG. 3 is a sectional view along the line 3—3 of FIG. 1, parts again being broken away.

A fulcrum assembly 40 is shown in FIGS. 1 and 3 to be mounted on the top 41 of platform 21 near but spaced inward from end 26 thereof. It includes a framework 42, conveniently of channel iron and comprising a top member 43, side members 44 and 45, and lower mounting flanges 46 and 47 for securement of the assembly to platform 21 by fasteners 50, 51: reinforcing gussets are shown at 52 and 53. A main fulcrum 54 of round steel is cross bored at its ends to accept a pair of height adjustment vertical screws 55, 56 having lower ends 57, 60 rotatably received and bottoming in holes 61, 62 in top 41, and carried in upper bearing 63, 64 in top member 43. The top ends of screws 55 and 56 are equipped with adjusting handles or cranks 65, 66, and thrust washers 67 may be provided.

Figure 2:
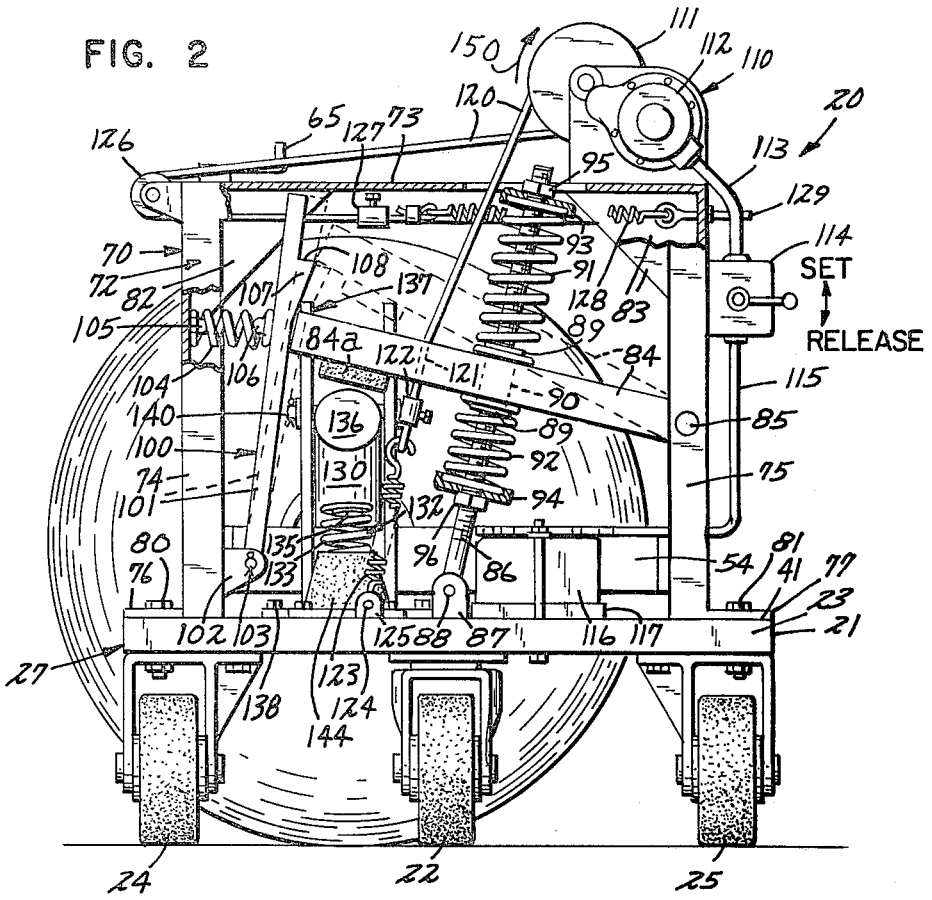
FIG. 2 is an elevational view along the line 2—2 of FIG. 1, portions broken away and shown in section.

A striker assembly 70 is shown in FIGS. 1 and 2 to be mounted on the top 41 of platform 21 near but spaced inward from end 23 thereof. It includes a framework 72, conveniently of channel iron and comprising a top member 73, side members 74 and 75, and lower mounting flanges 76 and 77 for securing the assembly to platform 21 by fasteners 80, 81. Reinforcing gussets are shown at 82 and 83.

A striker 84 is pivotably connected to side 75 for rotary movement within frame 72 about a horizontal pivot pin 85. Striker 84 conveniently comprises a pair of channel iron members welded together along their flanges, to define a central space which is filled with lead. A striker head **84*a* of suitable impact-resistant material such as hard rubber is provided on the under surface of striker 84**.

To determine the normal position of striker 84 a threaded rod 86 is secured to platform top 41 by a clevis 87 so that rod 86 is pivotable about a pin 88 having an axis parallel to that of pin 85. Rod 86 passes loosely through a hole 90 in striker 84, and carries a pair of stiff compression springs 91 and 92 centered about hole 90 by bosses 89. The springs are preferably alike, and are retained on rod 86 above and below striker 84 by cup washers 93 and 94 and nuts 95 and 96. Spring 92 urges the striker in a clockwise direction about pin 85, while spring 91 urges the striker in a counterclockwise direction. Nuts 95, 96 are so adjusted along shaft 86 that the striker normally assumes a generally horizontal attitude in frame 70, as shown in FIG. 2.

A trigger assembly 100 is shown to comprise a trigger arm 101 supported on frame side member 74 by a bracket 102 for pivotable movement about a pin 103 having an axis parallel to the axis of pin 85. Arm 101 is urged away from frame member 74 by a compression spring 104 positioned by bosses 105 and 106 carried by the member and the arm respectively. A ramp or rachet bracket 107 is secured to the face of arm 101 remote from frame member 74. In the normal position of striker 84, trigger arm 101 is pressed against the end of striker 84 by spring 104: if the striker moves clockwise about pin 85, the end of the striker moves up along and finally off of ramp 107, enabling spring 104 to pivot the arm clockwise so that the striker is supported on the end 108 of ramp 107, and cannot reverse its direction of motion.

A reversible electric winch 110 is mounted on top member 73 in any suitable fashion, and includes a drum 111 and a direct current motor 112 energized through a cable 113, a reversing switch 114, and a cable 115 from a battery 116 carried in a suitable protective mounting 117 on platform top 41. One end of a cable 120 wound around drum 111 passes through a hole 121 in striker 84, carries a stop collar 122 below the striker, and is connected through a tension spring 123, a pin 124, and a clevis 125 to platform top 41.

After passing around drum 111, cable 120 extends at its other end over a pulley 126 carried by frame side member 74, and through apertures in that member and in trigger arm 101, carries a stop collar 127, and is connected through a tension spring 128 and an eye-bolt 129 to frame side member 75. The arrangement is such that operation of motor 112 in a first or SET direction winds cable 120 in a direction to increase the tension in spring 123, and decrease the tension in spring 128, while motor operation in the opposite or RELEASE direction decreases the tension in spring 123 and increases that in spring 128.

The structure thus far described is designed to cooperate with a main bar or lever 130 to accomplish the objects of the invention. Lever 130 rests on main fulcrum 54 with one end 131 projecting beyond the end 26 of platform 21, and the other end extending through striker assembly 70 below striker head 86. The axis $A_2$ of lever 130 may be horizontal, but preferably slopes downward somewhat toward end 131: it is supported in this position by fulcrum 54 and a resilient support 132 in the form of a compression spring 133 mounted on platform top 41 and positioned by suitable means such as a base 134 on top 41 and a boss 135 on lever 130. The end 136 of lever 130 beyond support 132 passes between guide brackets 137 secured to platform top 41 as by fasteners 138. An adjustable headed pin 140 is provided to pass through selected pairs of aligned holes 141 in brackets 137, and to be secured in position as by a washer 142 and cotter key 143, to limit the upward movement of end 136 of lever 130, and an elastomeric bumper 144 is positioned on top 41 in alignment with support 132 to resiliently limit the downward travel of end 136 of lever 130.

OPERATION

To use my breaking apparatus a main lever 130 is positioned to rest on fulcrum 54 and support 132, with one end passing between brackets 137 and extending under striker head 84*a*. For an initial set-up it may be desirable to adjust nuts 95 and 96 on shaft 84*a* to give an optimum position for striker head 86. The apparatus is wheeled to the location of a set of rolls to be separated, lying on floor 13, and end 131 of lever 130 is inserted into the core of the outermost roll 10 for a distance less than the width of the roll nearest to it. I have found that an insertion of about six inches is sufficient. It will be appreciated that axis $A_1$ may be between fifteen inches and twenty-five inches above the floor, while the level of striker head 84*a* above the floor is fixed, unless platform 21 is adjustable in height. The weight of lever 130 tends to cause rotation of the lever on fulcrum 54 in a clockwise direction, opposed to spring 133, and the height of end 131 of the lever is accordingly adjusted by screws 55 and 56 to enable end 131 of the lever to be inserted into a roll 10 until bumper 30 engages the end of the roll, lever 130 being slightly spaced from striker head 84*a*.

Switch 114 is now thrown to the SET position, and motor 112 drives drum 111 in the direction of the arrow 150. Cable 120 begins to extend spring 123, stop collar 127 moves away from triggering arm 101, and stop collar 122 engages striker 84 to rotate it clockwise and compress spring 91. The end of striker 84 moves across trigger arm 101 until it passes ramp 107, when spring 104 pivots arm 101 clockwise to move under striker 84. A conventional limit switch, not shown, may be provided to interrupt energization of motor 112 at this time.

Next switch 114 is thrown to its REVERSE position, and the motor drives drum 111 in the opposite direction, moving cable 120 to release the tension in spring 123 and increase the tension in spring 128. Stop collar 122 moves away from striker 84, and stop collar 127 moves toward trigger arm 101, finally engaging the latter and displacing it counterclockwise until ramp 107 releases striker 84. The latter is driven by spring 91 in a counterclockwise direction, and head 84*a* impacts forcibly upon main shaft 130, urging it in a clockwise direction about fulcrum 54. One or a few of these operations is ususally encugh to break the rolls apart. A limit switch, not shown, as described above may also be provided to interrupt motor energization in the REVERSE direction.

For occasional stubborn cases, the effectiveness of the apparatus may be increased by raising the stubborn roll off the floor before operating the striker. This may be done by raising fulcrum member 54 through the use of cranks 65 and 66, or by the use of platform elevation apparatus if the cart is so equipped. It will be appreciated that downward force acting on end 131 of lever 130 would pivot the lever above fulcrum member 54 and raise end 136 out of its desired location with respect to striker head 86. To prevent this, a pin 140 is inserted in the appropriate holes 141 in brackets 137, limiting the upward movement of lever end 136 while not interfering with any downward shock due to the operation of striker head 84*a*.

As suggested in FIG. 6, the initial raising of the unseparated rolls 10, 11—the former being supported at 161 on lever 130 and the latter being supported at lever 160 on floor 13, introduces an initial shear force along the line 12 where the two rolls join, as indicated by the arrow 162. It has been found that under these conditions a few operations of striker assembly 70 causes separation of the most intimately associated rolls.

From the above it will be evident that I have invented apparatus for separating rolls of paper quickly, efficiently, safely, and without damage to the rolls. The apparatus is readily portable, and adapts readily to rolls of varying diameters and widths.

What is claimed is:

1. Roll breaking apparatus comprising, in combination:

a main lever having a first end, for insertion into one end of a paper roll to be broken from an axially abutting roll, and a second end remote therefrom;

a fulcrum arranged to support said main lever as a lever of the first class;

and a striker assembly arranged to impact said second end of said lever downwardly at a site remote from said fulcrum, to suddenly apply upward force to said first end of said lever.

2. Apparatus according to claim 1 including means enabling vertical adjustment of said fulcrum.

3. Apparatus according to claim 2 including means limiting the upward movement of said second end of said main lever.

4. Apparatus according to claim 1 in which the distance of said fulcrum from said first end of said main lever is less than its distance from said second end thereof.

5. Apparatus according to claim 4 and means resiliently supporting said second end of said main lever.

6. Roll breaking apparatus comprising, in combination:

a main lever having a first end, for insertion into one end of a paper roll to be broken from an axially abutting roll, and a second end remote therefrom;

a fulcrum arranged to support said main lever as a lever of the first class, the distance of said fulcrum from said first end of said main lever being less than its distance from said second end;

means enabling vertical adjustment of said fulcrum;

means resiliently supporting said second end of said lever;

means limiting the upward movement of said second end of said main lever;

and a striker assembly arranged to impact said second end of said lever downwardly at a site remote from said fulcrum, to suddenly apply upward force to said first end of said lever.

7. Roll breaking apparatus comprising, in combination:

a main lever having a first end, for insertion into one end of the paper roll to be broken from an auxiliary abutting roll, and a second end remote therefrom;

a fulcrum arranged to support said main lever as a lever of the first class;

a frame comprising a top member and first and second spaced side members;

a striker pivoted about a first horizontal axis to said first side member to extend generally horizontally in said frame for displacement between lower and upper positions therein along a path which intersects said second end of said main lever;

means resiliently urging said striker towards said lower position;

setting means actuable to displace said striker into said upper position;

means releasably actuable to retain said striker in said upper position;

trigger means actuable to release said releasable means; and reversible power means operable in a first sense to actuate said setting means and in a second sense to actuate said trigger means.

* * * * *